US005390653A

United States Patent [19]

Lee et al.

[11] Patent Number: 5,390,653

[45] Date of Patent: Feb. 21, 1995

[54] TWO HANDED TOSS AND CATCH TOY WITH ANGLE OF TOSS ADJUSTMENT

[75] Inventors: James S. W. Lee, Long Island, N.Y.; Chiu K. Kwan, Kowloon, Hong Kong

[73] Assignee: C. J. Associates, Ltd., Hong Kong

[21] Appl. No.: 994,546

[22] Filed: Dec. 21, 1992

[51] Int. Cl.[6] ..... F41B 7/08

[52] U.S. Cl. ..... 124/16; 124/1

[58] Field of Search ..... 124/1, 16, 79, 80

[56] References Cited

U.S. PATENT DOCUMENTS

| | | | |
|---|---|---|---|
| 438,237 | 10/1890 | Holmes | 273/324 X |
| 930,918 | 8/1909 | Barry . | |
| 1,777,976 | 10/1930 | Lacoste | 124/16 |
| 2,476,212 | 7/1949 | Nitz et al. . | |
| 2,636,738 | 4/1953 | Abagodd | 273/324 |
| 3,128,752 | 4/1964 | Andersen | 124/16 |
| 4,209,004 | 6/1980 | Kennedy | 124/16 X |
| 4,282,848 | 8/1981 | Kulesza et al. | 124/16 |
| 4,844,045 | 7/1989 | Powell et al. | 124/80 X |

*Primary Examiner*—Randolph A. Reese
*Assistant Examiner*—John Ricci
*Attorney, Agent, or Firm*—Laff, Whitesell, Conte & Saret, Ltd.

[57] ABSTRACT

A two handed toss and catch toy has a pistol-like body with a drive spring biased trigger rod to store energy in a drive spring in response to a manual motion. The stored energy flings a ball upwardly when the trigger rod is released. An upwardly directed basket is provided for catching balls as they fall back to earth. A tunnel magazine extends from the basket to a position where the balls are struck by the trigger arm in order to recycle caught balls for the next flinging.

9 Claims, 6 Drawing Sheets

TWO HANDED TOSS AND CATCH TOY WITH ANGLE OF TOSS ADJUSTMENT

This invention relates to toss and catch toys and more particularly to safe toys with an adjustable angle of toss.

There are many leisure toys, which may involve skill and be used for recreation, that are of interest only as long as the user believes that he is improving his skill level. As soon as he believes that he has more or less mastered the toy, he loses interest. Therefore, it is desirable for such a toy to have means for using a number of skills in order to provide a longer span of interest.

One outdoor type of play involves tossing and catching things. Of course, ball games immediately come to mind; however, most ball games require two or more players which introduce complications for people who are alone and must entertain themselves. There are only a very few toss toys or games which a person may play by himself. Many of these toys involve hard, pointed, or other dangerous items, such as darts, which are totally unsuited for children.

On the other hand, people do like to play games with each other. Thus, it is also good to provide toys which may be used, not only for solitary play when alone, but also may be used when two or more people are playing together.

Accordingly, a desirable toy involves both aiming in order to hit a target and tossing directly upwardly in order to catch the ball as it comes down. Therefore, it is desirable for the toy to be aimed both at another player and upwardly for solo play.

The inventive toy is especially designed for children; therefore, there is a heightened need for safety. For this reason, the tossed item is preferably a soft sponge rubber or plastic ball which does little or no damage even if the child is struck with a maximum force.

Various toys of this described type are shown in U.S. Pat. Nos. 438,237; 930,918; 2,476,212; and 2,636,738. Of these, only U.S. Pat. No. 930,918 (Barry) is of direct interest. However, this Barry toy is not designed for the kind of mass production which would produce a toy of such a low cost that it could be commercially feasible. Also, the Barry toy is a single handed toy where the player uses a finger to catapult or launch the ball; thus, it is not suitable for small children with relatively weak hands. Also, the range and trajectory of the Barry toy would necessarily be more limited than it could be. By way of contrast, the invention uses two hands so that the player can use the strength of his arms to play the game. The other three above cited patents show background art, which is not directly related to the invention.

Accordingly, an object of the invention is to provide new and improved toss and catch toys and games. In particular, an object is to provide a toy which may provide a greater variety of play.

Another object is to provide a safe toy, for even relatively small children to use.

In keeping with an aspect of the invention, these and other objects are accomplished by a pistol-like toy having means for shooting a soft foam ball into the air. An upwardly directed plastic basket is mounted on the pistol. When the ball returns to earth or reaches another player, the ball is caught in the basket, rolls down an incline, or reaches another player and returns to a magazine from which it may again be shot into the air.

A preferred embodiment of the invention is shown in the attached drawings, in which.

Figure 1:
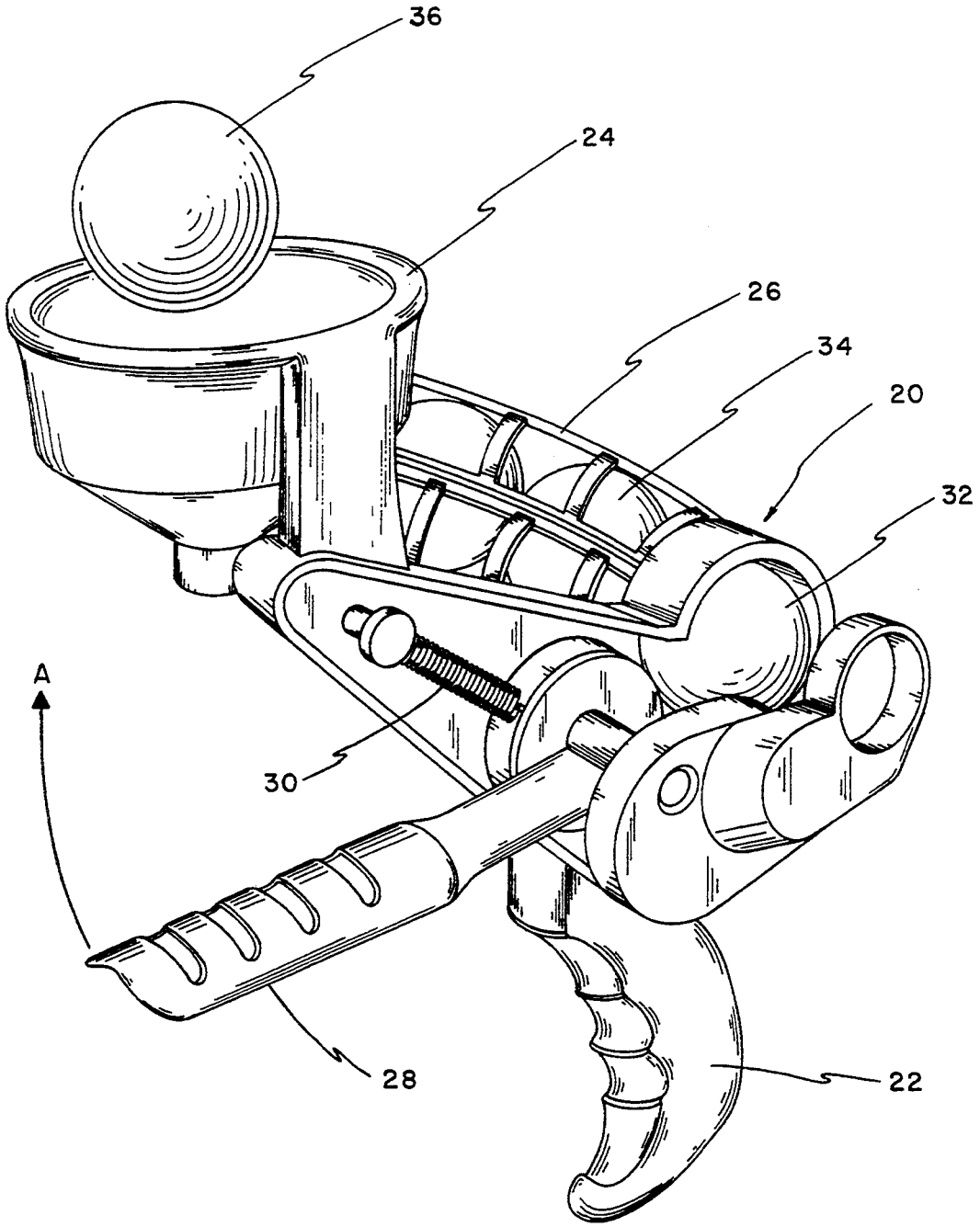
FIG. 1 is a perspective view of one embodiment of the invention with a catch basket on the front of the toy.

The two handed toy of FIG. 1 shows a pistol-like device 20 having a handle 22, a catch basket 24, a tunnel-magazine 26 which delivers the balls from the basket to a launch or catapult position, and a trigger lever 28 for shooting a ball that is in the launch position. The catch basket 24 is here shown on the front of the pistol-like device; however, the basket may also be on the back, or any other suitable location on the device. The balls may be made of any soft, sponge-like material, such as polyurethane, for example. A spring 30 provides catapulting energy to the trigger rod 28 for shooting or catapulting the ball.

The trigger rod 28 is pulled (direction A) against the bias of spring 30, to a position behind the handle 22, releasing a ball 32 in the process. The ball 32 rolls from the tunnel magazine 26 and into a launch position, from which it will be shot into the air when the trigger rod 28 is released. Energy stored in spring 30 pulls the trigger rod 28 to a normal position, and the ball is shot into the air. The next ball 34 rolls into the launch position, here shown as ball 32, the next time that the trigger rod is pulled back.

The ball 32 that is shot into the air may travel upwardly until it loses the initial energy imparted by trigger rod 28 striking ball 32. As the ball 32 falls back toward the earth, the user moves the catch basket 24 to a position where, hopefully, the ball 36 will fall into it (shown at 36). After the ball drops into the basket, it rolls down the tunnel-magazine 26, eventually reaching the launch position 32 from which it may again be launched when the trigger rod 28 is next operated.

Figure 2:
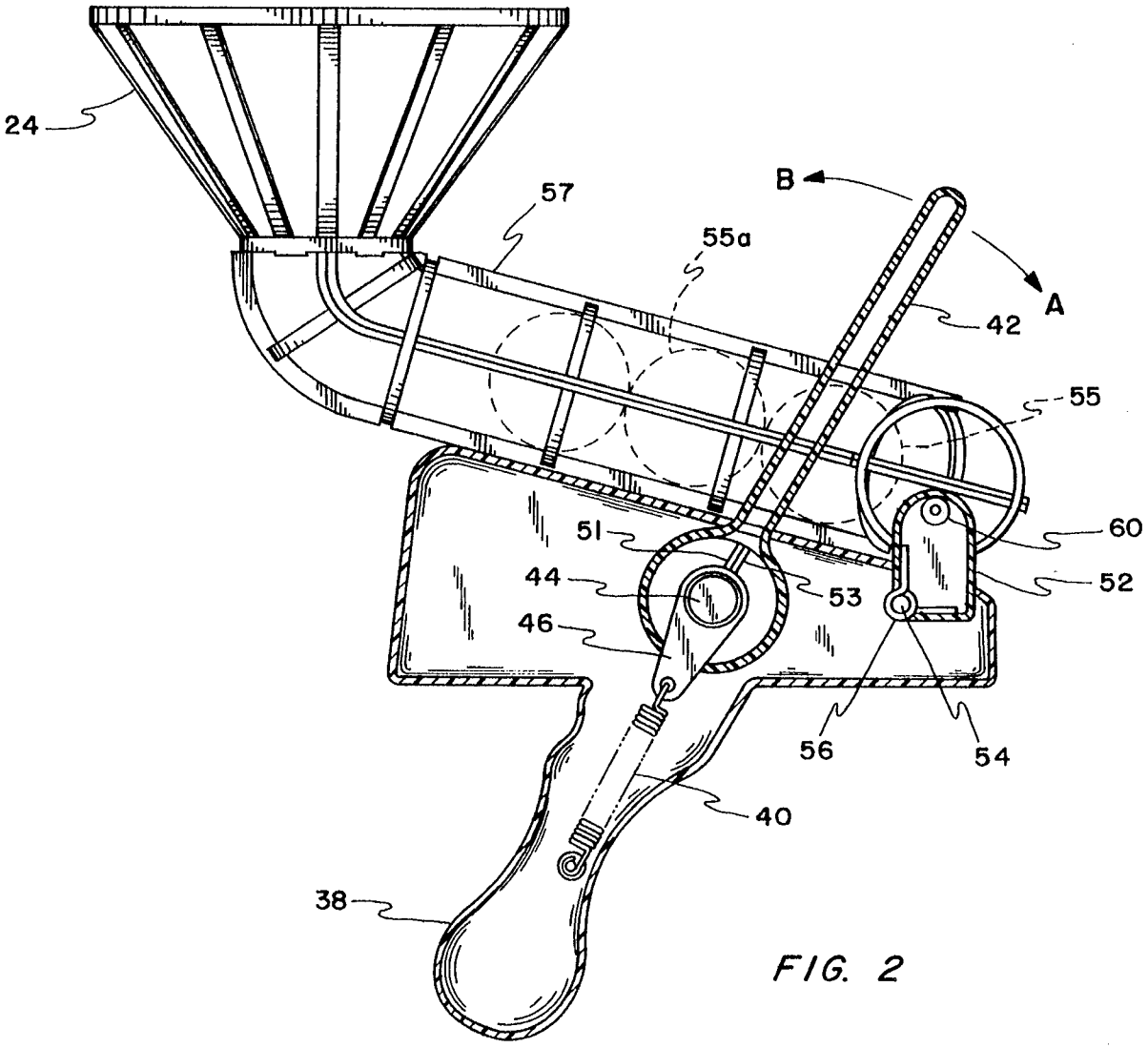
FIGS. 2–4 are three stop motion side elevation views of a second embodiment of the invention showing the mechanical action for catapulting or shooting the ball.
Figure 3:
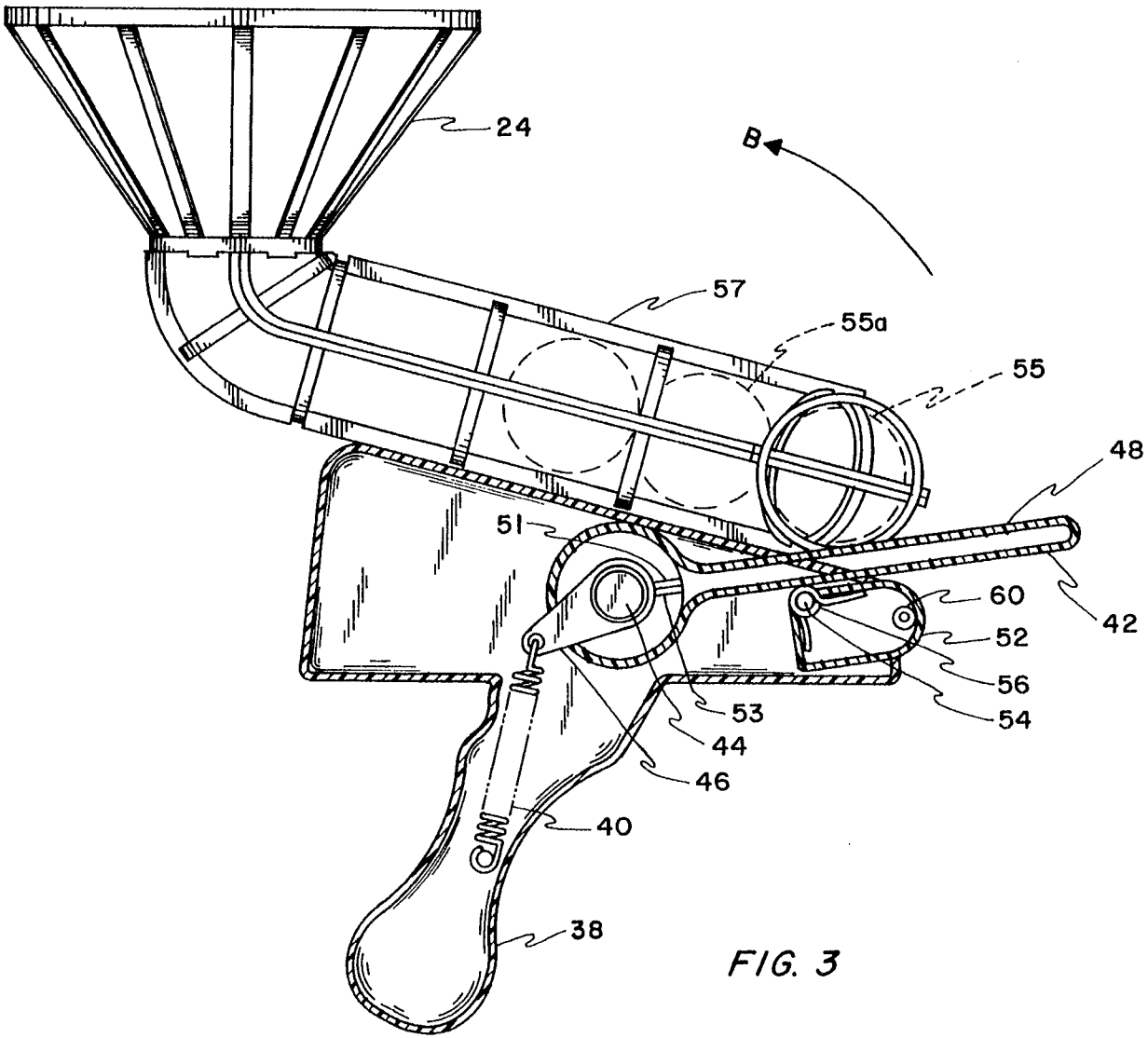
Figure 4:
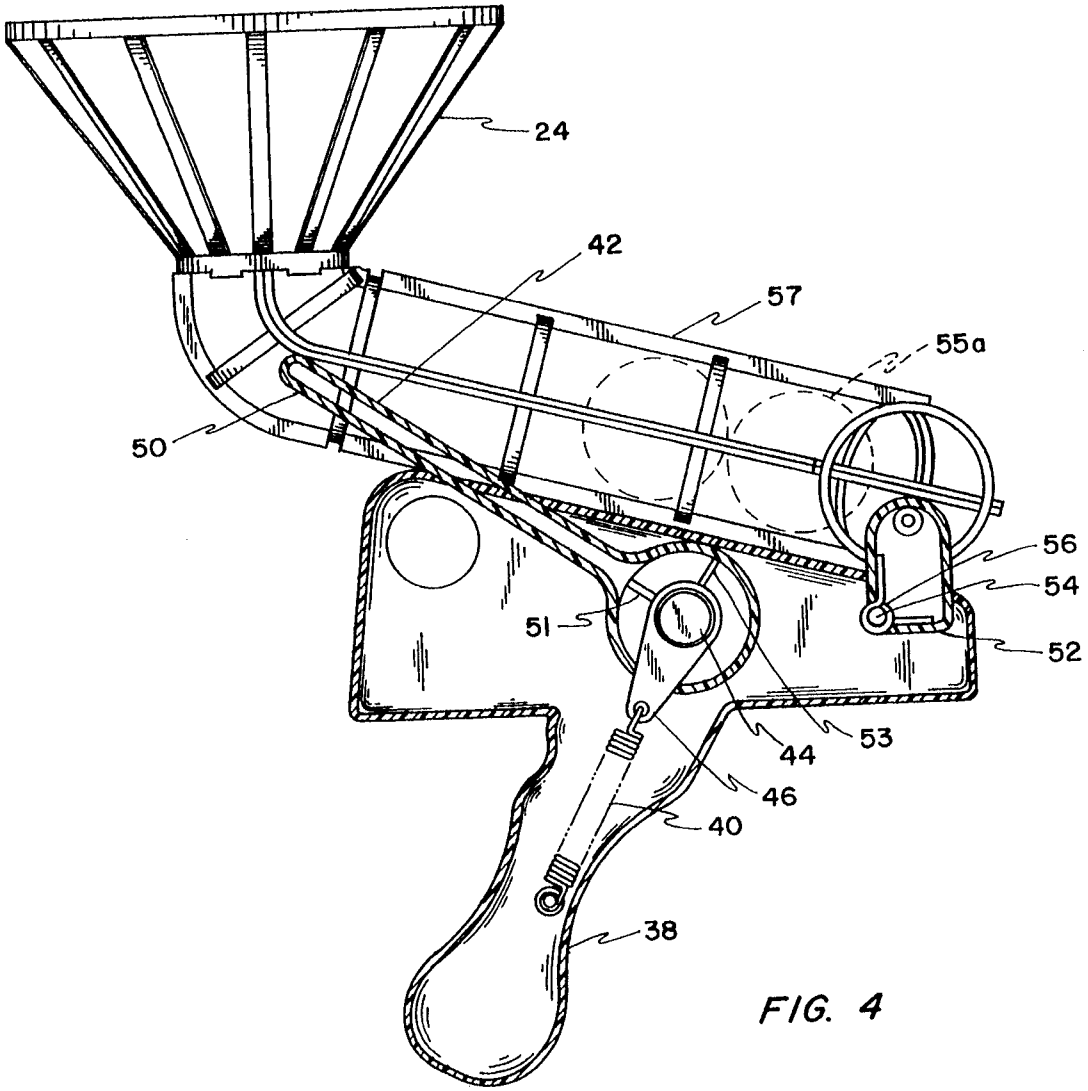

FIGS. 2–4 show another and similar embodiment where the handle 38 contains a preferably coiled drive spring 40. A trigger rod 42 is mounted on an axle 44 which, in turn, is associated with a spring arm 46 that is normally pulled to a downward position by coiled drive spring 40. In this position, the trigger rod 42 is held in a substantially vertical position, as seen in FIG. 2. If the trigger rod 42 is pulled down to position 48 (FIG. 3), for example, the spring arm 46 moves to another and off-normal position where the coiled drive spring 40 is stretched to store energy. When the trigger rod 42 is released from position 48 (FIG. 3), the energy stored in drive spring 40 pulls the spring arm 46 and swings the trigger rod 42 toward the upward position shown in FIG. 2.

The trigger rod 42 and spring arm 46 may be affixed to the same axle so that whenever one is moved, the other is also moved. In this case, when trigger rod 42 is pulled in direction A, spring arm 46 moves to stretch the spring. When the trigger-rod is released, it flips back in direction B. Any inertia carries the trigger rod 42 over center, the forward motion stretching the drive spring 40 and thereby absorbing the inertia. After the trigger rod 42 stops moving, the spring pulls it back to the position shown in FIG. 2, where it is ready for the next usage. This action has absorbed the inertia in a relatively short travel of the trigger rod.

According to another approach, at the upward position (FIG. 2), the trigger-rod 42 disconnects from spring arm 48 and continues its travel to an end position 50 (FIG. 4) so that the inertia of the swinging arm may be dissipated and need not be absorbed at once in a sudden stop. The mechanism for so disconnecting spring arm 42 from trigger rod 42 may be very simple. A tab 51 associated with trigger rod 42 is in front of (left as seen in FIG. 2) a tab 53 associated with spring arm 46. When trigger rod 42 is pulled back (direction A) throughout the range between positions 42 (FIG. 2) and 48 (FIG. 3), the tab 51 on arm 42 bears against the tab 53 associated with spring arm 46, at position 48 (FIG. 3), the tab 53 associated with spring arm 46 pushes against the tab 51 associated with trigger rod 42 while the energy stored in drive spring 40 is urging spring arm 46 to its normal position (FIG. 2).

In this embodiment, when the trigger rod 42 is released, the energy in drive spring 40 propels it in direction B (FIG. 2). Spring arm 46 stops moving when it reaches its lowest point (FIG. 2), but the tab 51 associated with trigger rod 42 is then free from its association with the tab 53 on spring arm 48 (FIG. 4). Therefore, the arm 42 may continue to rotate freely about its axle 44 until it reaches some forward position 50 where it stops. This way the inertia of the swinging trigger rod 42 does not have to be absorbed in a relatively short distance.

A ball stop 52 at the end of tunnel magazine 57 is a plastic plate which is pivoted at 54. A metal biasing spring 56 is disposed behind or within the plate forming ball stop 52 in order to urge the stop 52 to a normal vertical position where it prevents a ball 55 (FIG. 2) or 55*a* (FIG. 4) from rolling out of the magazine tunnel 57.

Figure 5:
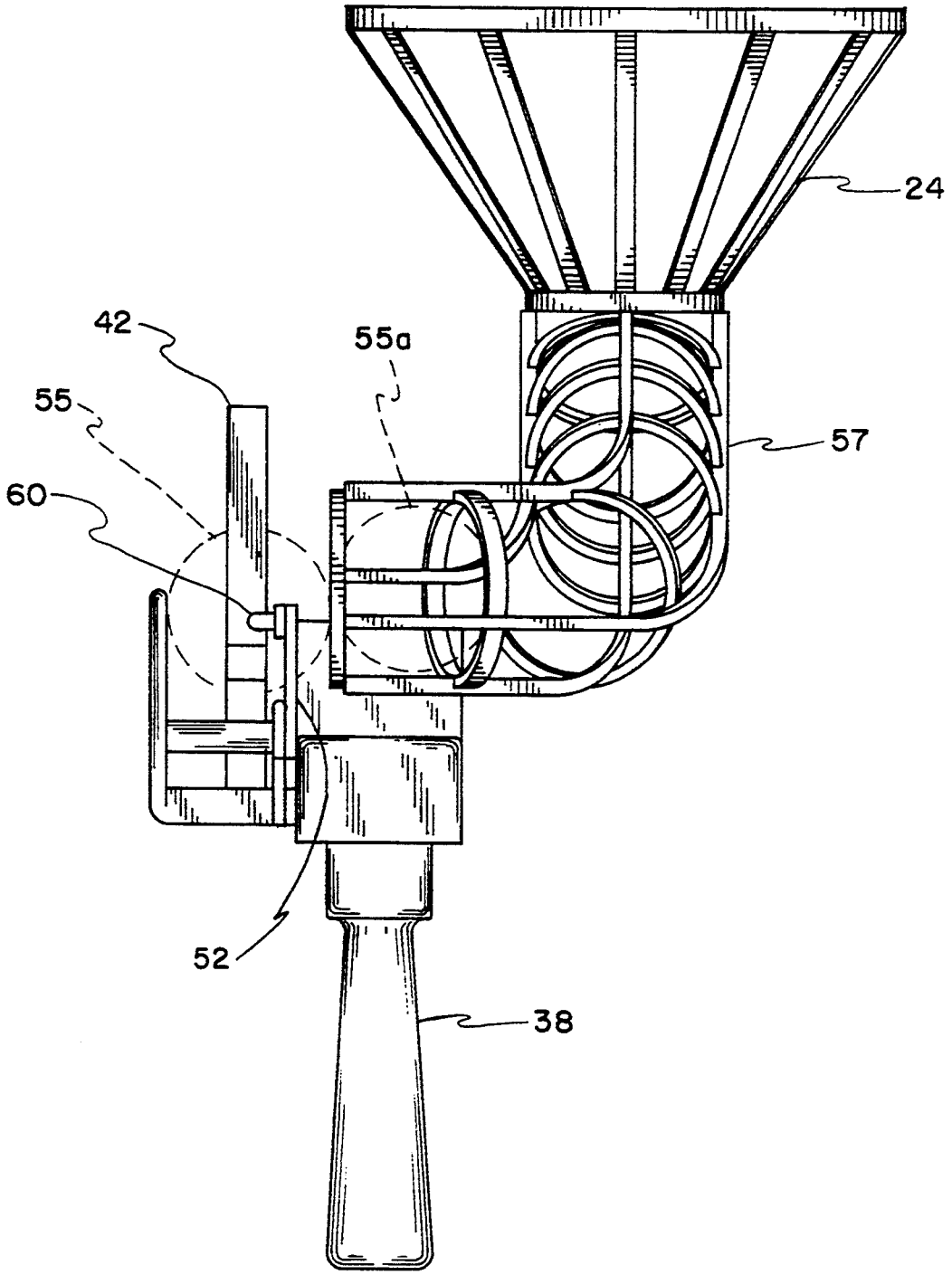
FIG. 5 is a back elevation of the toy.
Figure 6:
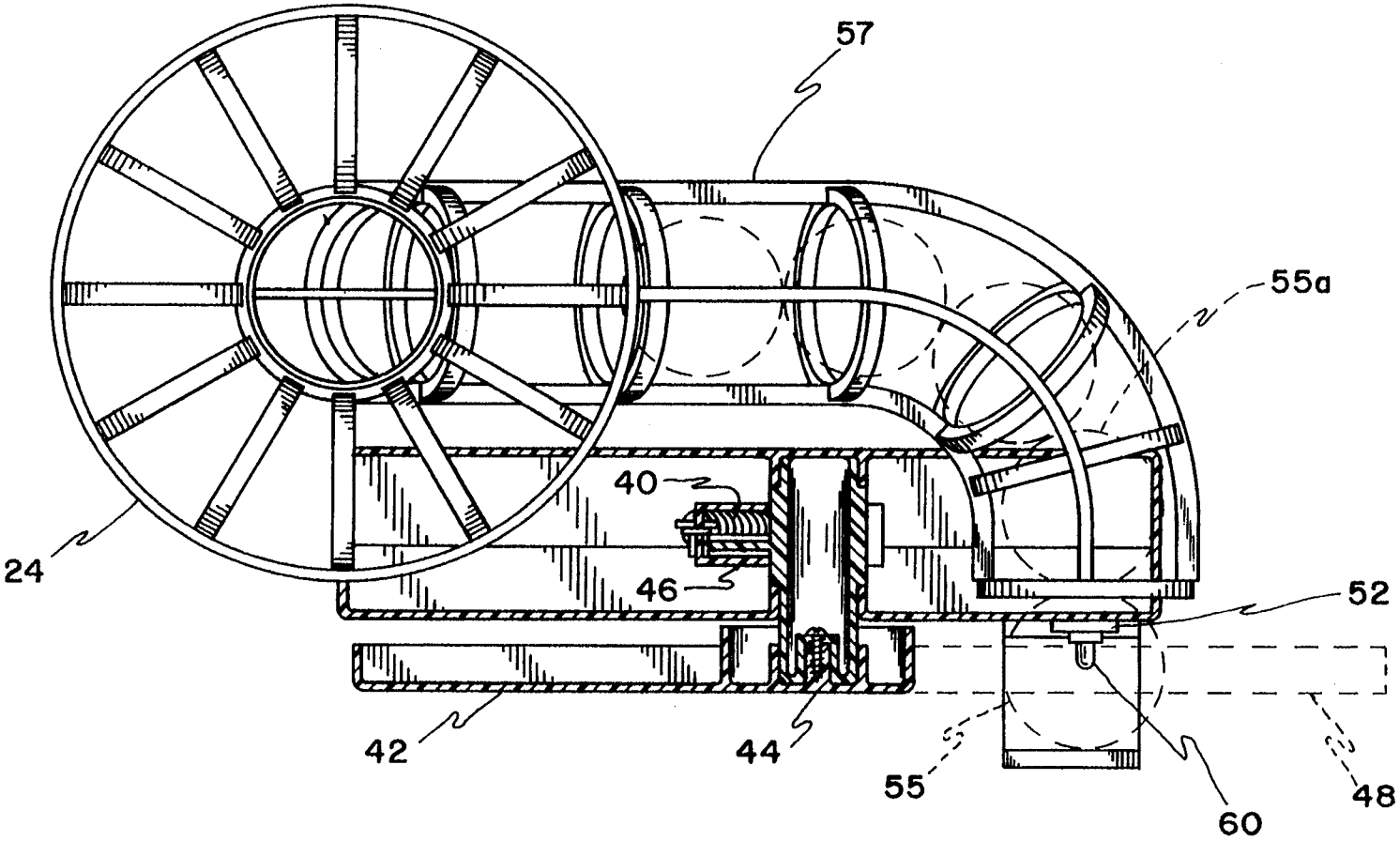
FIG. 6 is a top plan view of the toy.

A projection 60 fixed on the ball stop 52 extends outwardly (FIGS. 5, 6) where it engages the trigger rod 42 as it is pulled down (in direction A, FIG. 2) to position 48 (FIG. 3). As the trigger rod 42 bears against projection 60, the ball stop 52 moves about pivot point 54 and against the bias of biasing spring 56 to open the end of the tunnel magazine 57, which allows a ball 55 to roll into a launch position. From the position seen in FIG. 3, the drive spring 40 snaps the trigger rod 42 forward (direction B) when it is released from the rearward position 48. The ball 55 which just rolled out of the tunnel magazine 57 to the launch position is catapulted or flung into the air. The ball stop 52 moves back to its normal position (FIG. 4) as the trigger rod 42 moves away from position 48, to prevent the next ball 55*a* from moving to the launch position.

The next ball 55*a* may be shot by repeating the sequence of FIGS. 2–4.

When the ball 55 returns to earth, it is caught in basket 24 from which it returns to the tunnel magazine 57.

While the invention has been described in terms of tossing the ball into the air and catching it on the return, it should be understood that the pistol-like device may be used in other ways. For example, two people may stand facing each other, one shooting and other catching. Various things may be added to increase interest. For example, balls may have different colors to score different points. Sometimes the catcher may simply hold the catch basket and then shooter is scored according to whether he can lift the catch basket. Thus, the invention lends itself to players who make up their own rules.

Those who are skilled in the art will readily perceive how to modify the invention. Therefore, the appended claims are to be construed to cover all equivalent structures which fall within the true scope and spirit of the invention.

The claimed invention is:

1. A toss and catch toy comprising a portable structure having a hollow handle, said structure adapted for being held and moved about by a person grasping said handle, said hollow handle having a drive spring therein, an axle having a spring arm and a trigger rod mounted thereon, said drive spring being rotatably connected to a free end of said spring arm, said trigger rod being attached to said axle to cause said spring arm to store energy in said drive spring in response to movement of the trigger rod, a ball in a launch position to be struck and driven by said trigger rod as it moves responsive to said energy stored in said drive spring, means on said toy for catching said ball as it returns from a motion imparted by said trigger rod, and a tunnel magazine extending from said catching means to a position where said ball is struck by said trigger rod.

2. The toy of claim 1 and ball stop means associated with said trigger rod and said tunnel magazine for releasing a ball from said tunnel magazine to said launch position where said ball is struck by said trigger rod, said ball stop means being moved responsive to movement of said trigger rod.

3. A pistol-like toss and catch toy comprising a structure having a hollow handle with a drive spring therein, an axle having a spring arm and a trigger rod mounted thereon, said drive spring being connected to a free end of said spring arm, said trigger rod being attached to said axle to cause said spring arm to store energy in said drive spring in response to movement of the trigger rod, a ball in a launch position to be struck and driven by said trigger rod as it moves responsive to said energy stored in said drive spring, means on said toy for catching said ball as it returns from a motion imparted by said trigger rod, a tunnel magazine extending from said catching means to a position where said ball is struck by said trigger rod, and means responsive to said trigger rod moving a predetermined distance under the energy stored in said drive spring for thereafter enabling said trigger rod to disconnect from said drive spring and to travel freely and dissipate the inertia in it.

4. A pistol-like toss and catch toy comprising a structure having a hollow handle with a drive spring therein, an axle having a spring arm and a trigger rod mounted thereon, said drive spring being connected to a free end of said spring arm, said trigger rod being attached to said axle to cause said spring arm to store energy in said drive spring in response to movement of the trigger rod, a ball in a launch position to be struck and driven by said trigger rod as it moves responsive to said energy stored in said drive spring, means on said toy for catching said ball as it returns from a motion imparted by said trigger rod, a tunnel magazine extending from said catching means to a position where said ball is struck by said trigger rod, and means responsive to said trigger rod, moving a predetermined distance for dissipating the inertia in it by storing energy in said drive spring.

5. A portable device having a handle having a handgrip for enabling a person to hold said device aloft, a trigger rod rotatably mounted on said device and adapted for manual manipulation by the person, a tunnel magazine mounted on said device for delivering balls one at a time to a launch position, a drive spring associated with said device for storing energy when said trigger rod is moved in one direction and for using said stored energy to drive said trigger rod in an opposite direction, and a catch basket on said device for catching balls, said tunnel magazine delivering balls from said catch basket to a launch position where they are struck by said trigger rod when it is driven by said stored energy.

6. The device of claim 5 and a ball stop means positioned to stop said balls in said tunnel magazine, means responsive to movement of said trigger rod in said one direction for moving said ball stop means to release one of said balls to said launch position.

7. A pistol-like device having a handle for enabling a person to hold said device in one hand, a trigger rod rotatably mounted on said device for manipulation by the person's other hand, a tunnel magazine mounted on said device for delivering balls one at a time to a launch position, a drive spring associated with said device for storing energy when said trigger rod is moved in one direction and for using said stored energy to drive said trigger rod in an opposite direction, a catch basket on said device for catching balls, said tunnel magazine delivering balls from said catch basket to a launch position where they are struck by said trigger rod when it is driven by said stored energy, a ball stop means positioned to stop said balls in said tunnel magazine, means responsive to movement of said trigger rod in said one direction for moving said ball stop means to release one of said balls to said launch position; wherein said ball stop means includes a biasing spring for urging it to said ball stop position, said movement of said trigger rod moving said ball stop means against the bias of said biasing spring to release said ball.

8. The device of claim 7 wherein said handle is hollow and said drive spring is mounted therein; a crank arm coupling said drive spring to said trigger rod for storing said energy.

9. The device of claim 8 wherein said catch basket is directed upwardly on one side of said device and said trigger rod is on the other side of said device.

* * * * *